US007718871B1

(12) United States Patent
Stahnke

(10) Patent No.: US 7,718,871 B1
(45) Date of Patent: May 18, 2010

(54) SYSTEM AND METHOD FOR ACTUATING KEYS WITH DIFFERENT LEVER ADVANTAGES

(76) Inventor: Wayne Lee Stahnke, 316 California Ave., Suite 825, Reno, NV (US) 89509

( * ) Notice: Subject to any disclaimer, the term of this patent is extended or adjusted under 35 U.S.C. 154(b) by 376 days.

(21) Appl. No.: 12/008,895

(22) Filed: Jan. 15, 2008

(51) Int. Cl.
*G10F 1/02* (2006.01)
*G10H 1/46* (2006.01)

(52) U.S. Cl. ..... 84/21; 84/741

(58) Field of Classification Search ..... 84/622, 84/626, 633, 21, 741
See application file for complete search history.

(56) References Cited

U.S. PATENT DOCUMENTS

| | | | | |
|---|---|---|---|---|
| 5,756,910 | A * | 5/1998 | Fields et al. | 84/20 |
| 6,969,791 | B2 * | 11/2005 | Fujiwara | 84/13 |
| 6,992,241 | B2 * | 1/2006 | Fujiwara | 84/21 |
| 7,265,281 | B2 * | 9/2007 | Sasaki et al. | 84/13 |
| 7,279,630 | B2 * | 10/2007 | Sasaki et al. | 84/723 |
| 7,405,350 | B2 * | 7/2008 | Sasaki, Tsutomu | 84/13 |
| 7,432,430 | B2 * | 10/2008 | Sasaki | 84/462 |
| 7,435,895 | B2 * | 10/2008 | Muramatsu | 84/741 |
| 7,598,448 | B2 * | 10/2009 | Ohba | 84/626 |
| 2005/0145087 | A1 * | 7/2005 | Fujiwara | 84/1 |
| 2005/0247182 | A1 * | 11/2005 | Sasaki et al. | 84/13 |
| 2006/0000339 | A1 * | 1/2006 | Sasaki | 84/13 |
| 2006/0156905 | A1 * | 7/2006 | Sant | 84/600 |
| 2006/0185503 | A1 * | 8/2006 | Fujiwara | 84/626 |
| 2006/0213357 | A1 * | 9/2006 | Ohba | 84/723 |
| 2006/0219082 | A1 * | 10/2006 | Stahnke | 84/19 |
| 2007/0221035 | A1 * | 9/2007 | Muramatsu | 84/13 |

* cited by examiner

*Primary Examiner*—Jeffrey Donels
*Assistant Examiner*—Andrew R Millikin

(57) ABSTRACT

The keys in a reproducing piano are actuated by a plurality of solenoids, one for each key to be played. The solenoids are arranged along the width of the keyboard and deviated from each other in the front-back direction of the keys in a staggered manner. A consequence of this arrangement is that the mechanical lever advantage of some solenoids is greater than the mechanical lever advantage of others, and as a result, some keys are played more loudly than others. In order to correct this problem, the drive applied to a solenoid is adjusted to compensate for the mechanical lever advantage, thereby allowing a performance to be accurately reproduced.

30 Claims, 5 Drawing Sheets

SYSTEM AND METHOD FOR ACTUATING KEYS WITH DIFFERENT LEVER ADVANTAGES

CROSS-REFERENCE TO RELATED APPLICATION

This application is related to co-pending application serial number 097211, filed on Apr. 4, 2005. That patent application is hereby incorporated in its entirety.

BACKGROUND OF THE INVENTION

1. Field of the Invention

The present invention relates to a system and method for controlling mechanically-driven musical instruments, and in particular to a system and method for controlling the drive of actuators in a mechanically-driven piano or other instrument.

2. Background of the Technology

Beginning with the invention of pneumatically-driven reproducing pianos in the early twentieth century, systems and methods have been developed for recording music played by a human pianist and for reproducing that music on a piano. Many of these systems and methods have attempted to reproduce not only the temporal sequence of notes played by the pianist, but also their dynamics or the sharp contrasts and subtle shadings in loudness that help to make piano performances pleasing. The overall problem of reproducing dynamics can be divided into two distinct parts: recording the dynamics played by a pianist, and recreating these dynamics on a piano.

The problem of recording the dynamics played by a pianist is addressed, for example, in U.S. Pat. No. 4,307,648 to Stahnke issued Dec. 29, 1981, which is hereby incorporated by reference in its entirety. However, there is an unmet need in the art for improved systems and methods for recreating the recorded dynamics.

In an application such as a mechanically-driven piano, recorded music is recreated, for example, using solenoids or other actuators. One actuator is provided for each key of the piano. Each actuator controls the movement of one piano key to recreate recorded music. The actuators may be operated at various speeds to recreate the dynamics of the recorded music.

The actuators may be situated below the back ends of the keys and driven by electrical signals reproduced from a recorded medium, thereby depressing the keys as if they were played by a human pianist. The loudness of each note may be controlled by the drive provided to the actuator for the corresponding key. For example, if a loud note is desired, a larger drive is provided to the actuator, and the actuator is operated at a relatively fast speed. The key is depressed quickly and a relatively loud note is played. In contrast, if a soft note is desired, a smaller drive is provided to the actuator, and the actuator is operated at a relatively slow speed. The key is depressed more slowly and a relatively soft note is played.

In many prior art systems, the actuators are solenoids. A solenoid may consist, for example, of a drive coil, a moveable ferromagnetic plunger movably inserted through a bobbin of the drive coil, and a yoke and polepiece that contain the drive coil and form a magnetic path.

The keyboard of a piano is arranged to accommodate a human hand. If the actuators were configured side by side in a single row underneath the keys, the size of the actuator would be severely limited. Consequently the maximum force that it would be able to produce would also be limited, and loud passages could not be accurately reproduced. Thus, in some systems, the actuators are arranged in a staggered manner so that the size of each solenoid can be increased, as required to play loudly.

The actuators may be staggered vertically (with one row of solenoids above another) or horizontally (in the front-back direction). A vertically-staggered arrangement of solenoids is shown, for example, in U.S. Pat. No. 4,121,491 to Wilkes. A horizontally-staggered arrangement of solenoids is shown, for example, in U.S. Pat. No. 4,741,237 to Murakami and Tajima. Both arrangements are shown in U.S. Pat. No. 3,426,304 to Cannon and Morse.

As shown in FIG. 1 (Prior Art), staggering the solenoids vertically allows the plungers (not shown in FIG. 1) and plunger extensions 106, 118 to be arranged in a single row. This arrangement has the advantage of providing a uniform lever advantage for keys of the same color, but there are two disadvantages: the solenoids 116 protrude beneath the piano in an unsightly way, and the lower row or rows of solenoids 116 suffer from having long plunger extensions 118 that may become cocked, which compromises the ability to play softly.

A horizontal arrangement of the solenoids is shown in FIG. 2 (Prior Art). This arrangement allows an installation that is nearly invisible, because the solenoids 35 can be mounted with most of their height concealed within the keybed. In addition, the plungers 12 are supported within the bobbins 30 very close to the keys, eliminating the long plunger extensions required by a vertical arrangement. However, the fact that the plungers 12 are staggered along the length of the keys causes the lever advantage of the front row to be less than the lever advantage of the back row or rows.

In the vertically-staggered arrangement shown in FIG. 1, there are two different lever advantages. The black keys have their pivotal axes further toward the rear of the keys than the white keys, creating a larger lever advantage. Thus, applying a drive to an actuator beneath a black key results in a dynamic different from the dynamic that results from applying the same drive to a solenoid beneath a white key. This discrepancy results from the physical construction of the piano. If the design of the actuator is such that its velocity is substantially independent of force for a given drive, a black key will play more softly than a white key. On the other hand, if the actuator design is such that its force is substantially independent of velocity for a given drive, a black key will play more loudly. For solenoids of conventional construction, force is largely independent of velocity for a given drive and a black key will play more loudly.

In the horizontally-staggered arrangement, there are four different lever advantages. In addition to the inherent discrepancy between the black and the white keys, there is an additional discrepancy resulting from the horizontally-staggered arrangement itself. Plungers in the front row strike the keys closer to their pivotal axes, so the lever advantage is smaller. Plungers in the back row or rows strike the keys further from their pivotal axes, so the lever advantage is larger. Thus, for a horizontally staggered-construction with two rows, there are four different lever advantages (white keys in the front row, black keys in the front row, white keys in the back row, black keys in the back row). For arrangements with three or more horizontally-staggered rows, the number of lever advantages increases. For solenoids of conventional construction force is largely independent of velocity for a given drive, and keys played by solenoids in the back row will play more loudly than similar keys played by solenoids in the front row.

There is an unmet need in the art for an improved method for driving actuators that overcomes the inaccurate dynamics that result from multiple lever advantages.

SUMMARY OF THE INVENTION

It is an object of the present invention to reduce or eliminate inaccurate dynamics that result from multiple lever advantages.

In one embodiment of the present invention, the drive provided to each actuator is scaled to compensate for the lever advantage of the corresponding key. Because the drive provided to the actuator controls the loudness of the note, adjusting the drive can effectively compensate for the different lever advantages.

In one embodiment of the invention, one or more lever scaling factors are determined. A lever scaling factor is, for example, a number or ratio that describes the loudness or lever advantage of a particular key or set of keys.

During playback of a musical performance, the drive provided to each actuator is scaled based on the lever scaling factor for the corresponding key. This eliminates the differences in loudness that result from differing lever advantages, resulting in a more pleasing musical performance.

In another embodiment of the invention, the lever scaling factor or scaling factors are used to create one or more lookup tables. During playback of a musical performance, the lookup tables are consulted in order to determine an appropriately scaled drive for each note.

DETAILED DESCRIPTION

Embodiments of the invention provide systems and methods for driving actuators in a reproducing piano or other musical instrument. During playback of a musical performance, actuators effect movement of the keys. Because of the arrangement of the actuators and because of the construction of the piano, the keys have different lever advantages. This results in inaccurate dynamics: for a given drive, some notes are played more loudly than others. In order to compensate for the different lever advantages, the drive to each actuator may be scaled. Thus, inaccurate dynamics may be reduced or eliminated.

Example embodiments will now be described in conjunction with the following figures.

Figure 1:
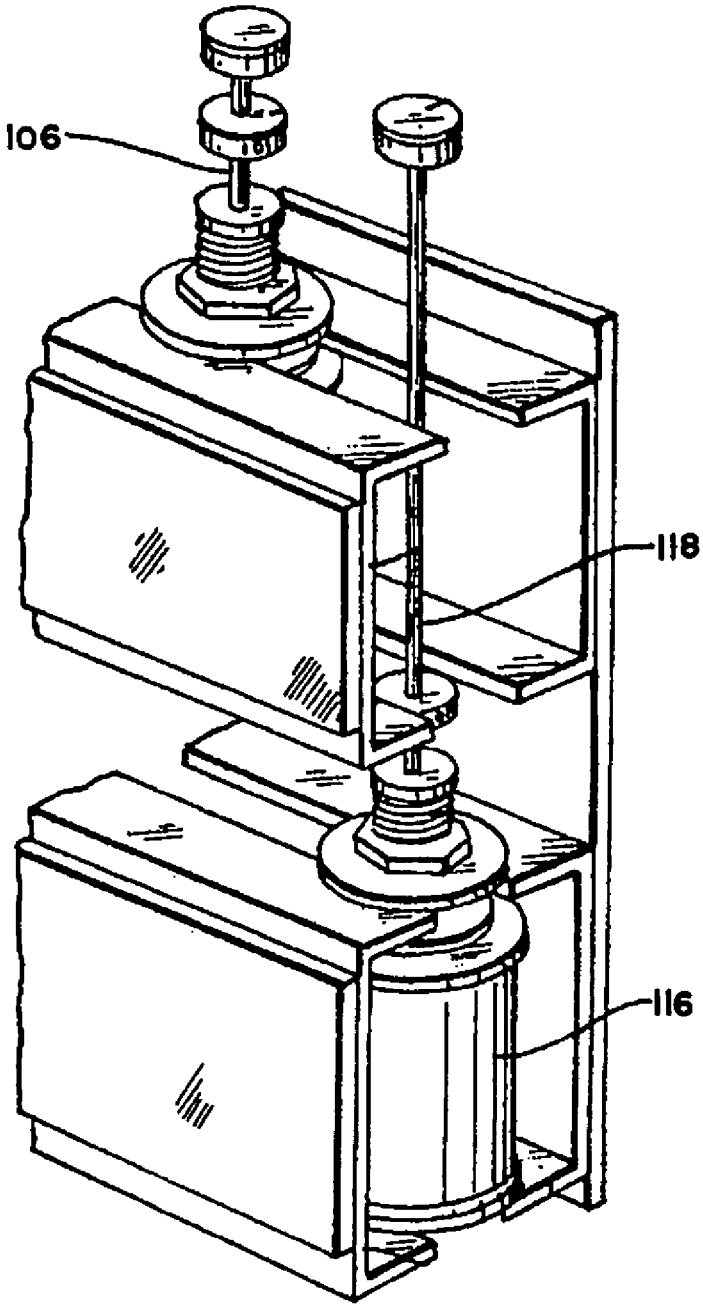
FIG. 1 is a fragmentary perspective view of a prior art vertically-staggered arrangement of actuators, in conjunction with which embodiments of the invention may be practiced.
Figure 2:
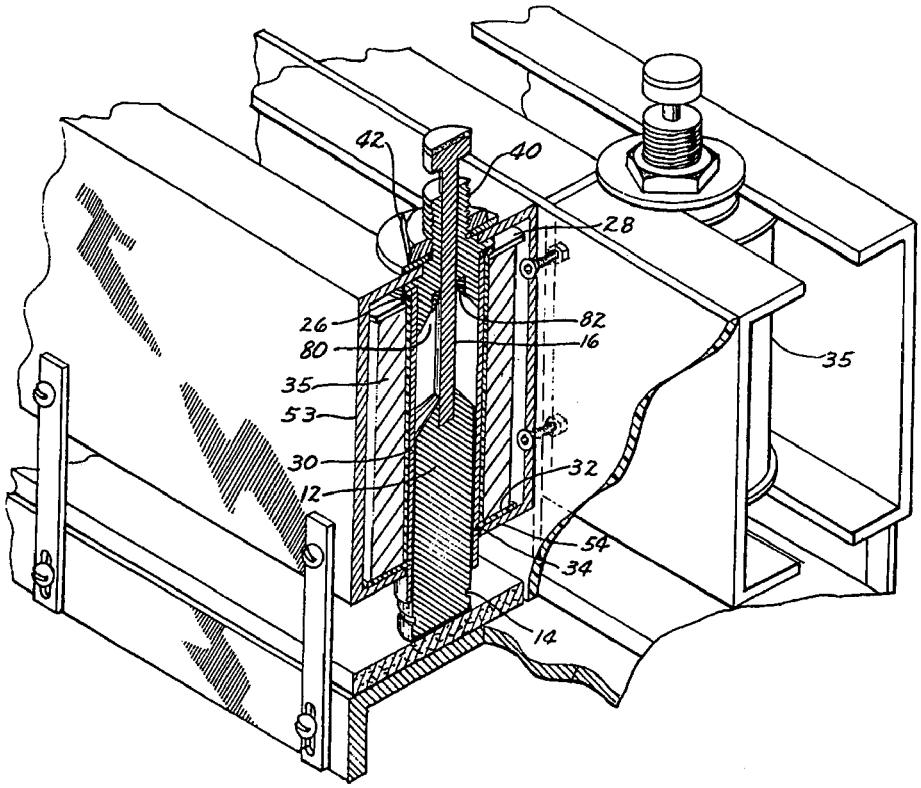
FIG. 2 is a fragmentary perspective view of a prior art horizontally-staggered arrangement of actuators, in conjunction with which embodiments of the invention may be practiced.
Figure 3:
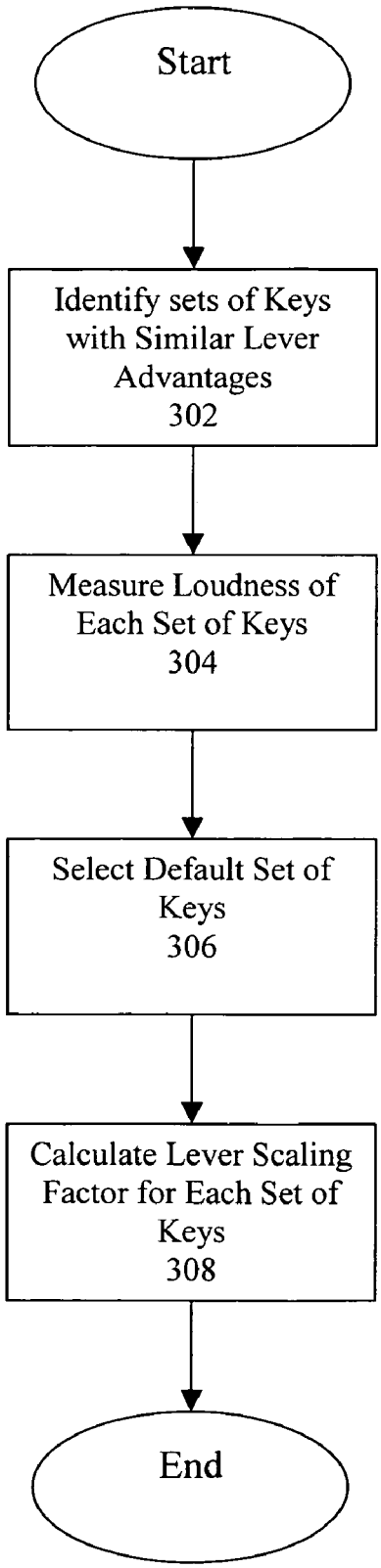
FIG. 3 is a flow chart illustrating a method for determining lever scaling factors, in accordance with an embodiment of the invention.

FIG. 3 is a flow chart illustrating a method for determining lever scaling factors, in accordance with an embodiment of the invention. The method begins in step 302, wherein sets of keys with similar lever advantages are identified. For example, if the if the actuators are in a vertically-staggered arrangement, two sets of keys may be identified: the white keys and the black keys. If the actuators are in a horizontally-staggered arrangement with two rows of actuators, four sets of keys may be identified: the white keys in the front row, the black keys in the front row, the white keys in the back row, and the black keys in the back row. Alternatively, in a horizontally-staggered arrangement with two rows of actuators, only two sets of keys may be identified, the keys in the front row and the keys in the back row. This simplified process may be used, for example, to compensate for the different lever advantages stemming from the placement of the actuators, without compensating for the different lever advantages stemming from the physical construction of the piano. Other sets of keys may be identified for other arrangements of actuators.

The method continues in step 304, wherein the loudness of each set of keys may be measured, for example, by testing. The loudness of each set of keys may be measured, for example, by providing the same drive to each actuator, one at a time, and measuring the loudness of each note using, for example, the method described and illustrated in U.S. Pat. No. 4,307,648. In one implementation, the loudness of a number of keys in each group is tested repeatedly, and the results are averaged or otherwise mathematically combined.

The method continues in step 306, wherein a default set of keys may be selected. The default set of keys may be used, for example, as a basis for comparison for the relative loudness of each set of keys. In one embodiment, the drives to the actuators for the default set of keys will not be adjusted. The drives for all other actuators will be adjusted in order to bring them into conformity with the loudness of the default set of keys.

The default set of keys may be selected, for example, to be the softest set of keys, such as the white keys that are played by solenoids in the front row. In this case, the drives to all other keys will be reduced to bring them into conformity with the loudness of the softest set. This eliminates the risk that the dynamics will be flattened at the high end of the dynamic range.

In an alternate embodiment, no default set of keys is used. Rather, the loudness of all keys is adjusted to bring them into conformity with an abstract standard.

The method continues in step 308, wherein the lever scaling factor for each set of keys is calculated. If a default set of keys is used, the lever scaling factor for the default set of keys may be set to a predetermined standard, such as "1" (unity).

The lever scaling factor for each set of keys may be any number or ratio that describes the relative loudness of that set of keys. In one embodiment, the lever scaling factor for a set of keys is equal to the loudness of the default set of keys, divided by the loudness of the set of keys under investigation. For example, if the default set of keys has an average loudness of 30 dB for a particular drive, and the set of keys under investigation has an average loudness of 34 dB for the same drive, the lever scaling factor may be 30 dB/34 dB=0.95238. Other methods for calculating the lever scaling factor may be used.

Figure 4:
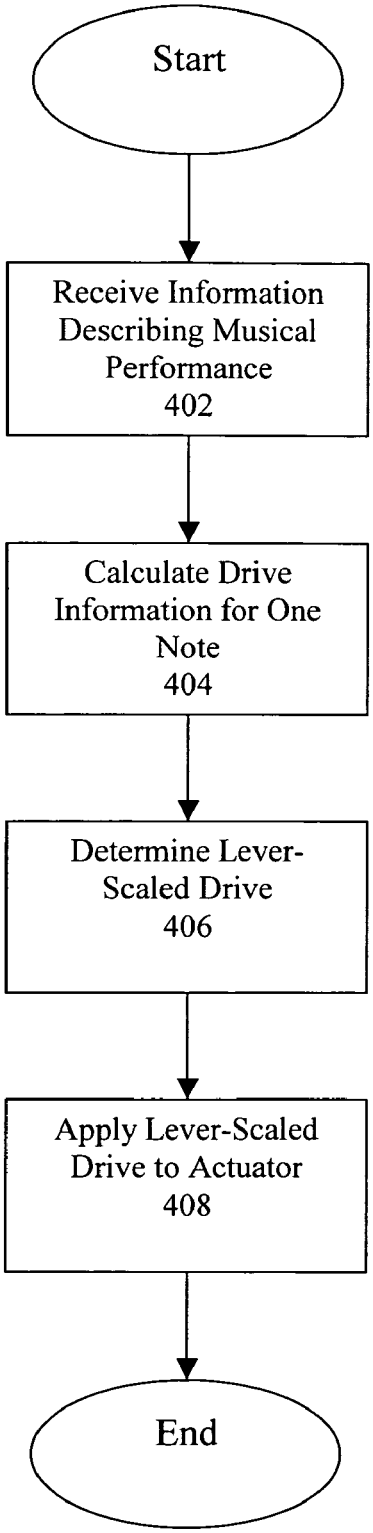
FIG. 4 is a flow chart illustrating a method for driving an actuator, in accordance with an embodiment of the invention.

FIG. 4 is a flow chart illustrating a method for driving an actuator, in accordance with an embodiment of the invention. The method begins in step 402, where information describing a musical performance may be received, for example, from a disk or other medium. The information contains instructions sufficient to control the actuators to play various notes at various loudnesses in a temporal sequence, creating a musical performance.

The method continues in step 404, where drive information for one note is calculated. The drive information is calculated based on the information received in step 402 using methods known in the art. The drive information includes information identifying an actuator, and information specifying the amount of drive to be applied to that actuator. The amount of drive determined in step 404 shall be referred to as the "normalized drive," because it does not include any compensation for different lever advantages.

The method continues in step 406, wherein a lever-scaled drive is determined. The lever-scaled drive may be determined, for example, based on the lever scaling factor for the actuator. If the lever scaling factor is determined by dividing the loudness of the default set of keys by the loudness of the set of keys under investigation, as discussed with reference to FIG. 3, then the lever-scaled drive may be determined by multiplying the normalized drive by the lever scaling factor. Continuing the example from FIG. 3, the drive to the actuator would be multiplied by 0.95238. Thus, the drive to the actuator is decreased somewhat, resulting in a note that is played slightly more softly. This compensates for the increased loudness of the key resulting from lever advantage.

The method continues in step 408, where the lever-scaled drive is applied to the actuator. The lever-scaled drive compensates for the lever advantage of each key. The result is a reduction in dynamic inaccuracies and a more pleasing musical performance.

Figure 5:
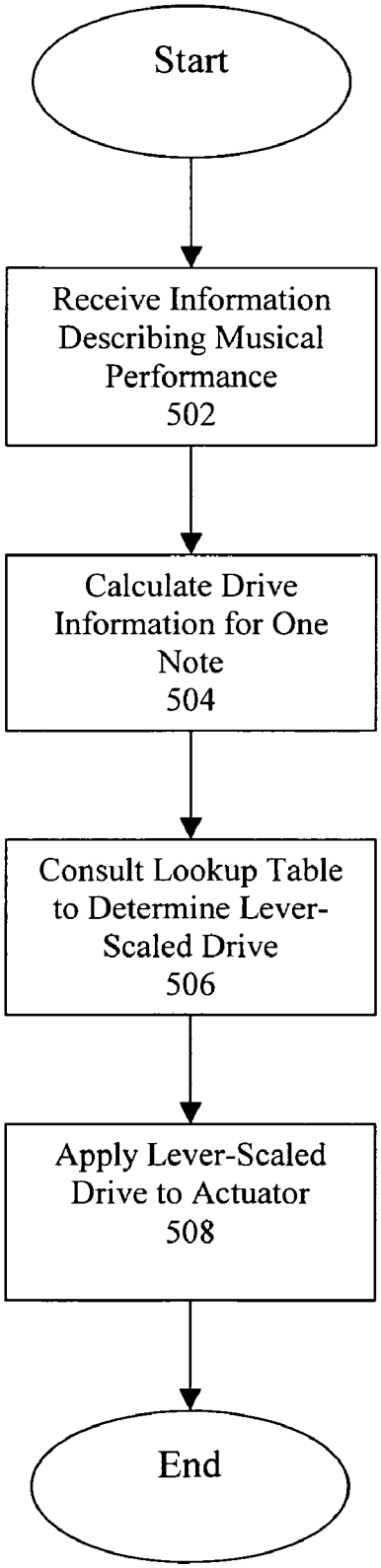
FIG. 5 is a flow chart illustrating a method of driving an actuator, in accordance with an embodiment of the invention.

FIG. 5 is a flow chart illustrating a method of driving an actuator, in accordance with an embodiment of the invention. In the method of FIG. 5, one or more lookup tables may be used to store the lever-scaled drives for each set of keys. The lookup tables may be generated using the lever scaling factors determined according to the method described with reference to FIG. 3. In this way, the lever-scaled drives for each set of keys may be calculated in advance. Using the method of FIG. 5, determining the lever-scaled drive may then be performed using a lookup operation, rather than performing a calculation as described with reference to FIG. 4.

The method begins in step 502, where information describing a musical performance may be received, for example, from a disk or other medium. The information contains instructions sufficient to control the actuators to play various notes at various loudnesses in a temporal sequence, creating a musical performance.

The method continues in step 504, where drive information for one note is calculated. The drive information is calculated based on the information received in step 502 using methods known in the art. The drive information includes information identifying an actuator, and information specifying the amount of drive to be applied to that actuator, known as the "normalized drive."

The method continues in step 506, wherein a lookup table is consulted to determine the lever-scaled drive. The normalized drive may be used as the address of the lookup table. The lookup table may contain the lever-scaled drive. Alternatively, the lookup table may contain the difference between the example drive and the lever-scaled drive, or any other information that may be used to determine the lever-scaled drive. In alternate implementations, the lookup table may contain fewer entries than there are actuator drives. The modified drive may be found by interpolating or extrapolating for those values of example drive for which there is no table entry.

In still another embodiment of the invention, multiple lookup tables are provided, one for each set of keys. The normalized drive is used as the address of the lookup table corresponding to the lever advantage of the key to be played. Each lookup table may contain as many entries as there are example drive values, or it may contain fewer entries, in which case the lever-scaled drive is found by interpolating or extrapolating for those values of example drive for which there is no table entry.

The method continues in step 508, where the lever-scaled drive is applied to the actuator. The lever-scaled drive compensates for the lever advantage of the key. The result is a reduction in dynamic inaccuracies and a more pleasing musical performance.

Example embodiments of the present invention have been described in accordance with the above advantages. It will be appreciated that these examples are merely illustrative of the invention. Variations and modifications will be apparent to those skilled in the art. For example, while the invention has generally been described in terms of finding a single lever scaling factor, those skilled in the art will recognize that the lever scaling factor may vary with the loudness of the note to be played. Accordingly, a number of lever scaling factors may be determined for each set of keys, each appropriate for a particular range of dynamics or drives. Alternatively, the lever scaling factor may be described as an equation, varying with the normalized drive. In other implementations, the lever scaling factor may not be used, and other mathematical equations may be used to determine the lever-scaled drive from the normalized drive. Other modifications will be apparent to those skilled in the art.

What is claimed is:

1. A method for driving an actuator in an instrument, comprising:

receiving drive information, the drive information comprising actuator information identifying an actuator and normalized drive information specifying a normalized drive;

determining a lever-adjusted drive based on the actuator information and the normalized drive information; and applying the lever-adjusted drive to the identified actuator.

2. The method of claim 1, wherein the lever-adjusted drive is determined based on a lever scaling factor.

3. The method of claim 2, wherein the lever-adjusted drive is determined by multiplying the normalized drive by the lever scaling factor.

4. The method of claim 2, further comprising identifying a lever advantage set based on the actuator information.

5. The method of claim 4, further comprising identifying the lever scaling factor based on the lever advantage set.

6. The method of claim 4, wherein the lever scaling factor has been determined by testing the loudness of a plurality of keys associated with the lever advantage set.

7. The method of claim 4, wherein the lever scaling factor is calculated by dividing a first loudness associated with a default lever advantage set by a second loudness associated with the lever advantage set.

8. The method of claim 1, wherein the lever-adjusted drive is determined by consulting a lookup table.

9. The method of claim 8, wherein the normalized drive is used an address of the lookup table.

10. The method of claim 8, further comprising:

selecting the lookup table from a plurality of lookup tables based on the actuator information.

11. A system for driving an actuator in an instrument, comprising:

means for receiving drive information, the drive information comprising actuator information identifying an actuator and normalized drive information specifying a normalized drive;

means for determining a lever-adjusted drive based on the actuator information and the normalized drive information; and means for applying the lever-adjusted drive to the identified actuator.

12. The system of claim 11, wherein the lever-adjusted drive is determined based on a lever scaling factor.

13. The system of claim 12, wherein the lever-adjusted drive is determined by multiplying the normalized drive by the lever scaling factor.

14. The system of claim 12, further comprising means for identifying a lever advantage set based on the actuator information.

15. The system of claim 14, further comprising means for identifying the lever scaling factor based on the lever advantage set.

16. The system of claim 14, wherein the lever scaling factor has been determined by testing the loudness of a plurality of keys associated with the lever advantage set.

17. The system of claim 14, wherein the lever scaling factor is calculated by dividing a first loudness associated with a default lever advantage set by a second loudness associated with the lever advantage set.

18. The system of claim 11, wherein the lever-adjusted drive is determined by consulting a lookup table.

19. The system of claim 18, wherein the normalized drive is used an address of the lookup table.

20. The system of claim 18, further comprising:

means for selecting the lookup table from a plurality of lookup tables based on the actuator information.

21. A computer-readable medium encoded with instructions executable to perform a method comprising:

receiving drive information, the drive information comprising actuator information identifying an actuator and normalized drive information specifying a normalized drive;

determining a lever-adjusted drive based on the actuator information and the normalized drive information; and applying the lever-adjusted drive to the identified actuator.

22. The computer-readable medium of claim 21, wherein the lever-adjusted drive is determined based on a lever scaling factor.

23. The computer-readable medium of claim 22, wherein the lever-adjusted drive is determined by multiplying the normalized drive by the lever scaling factor.

24. The computer-readable medium of claim 22, further comprising identifying a lever advantage set based on the actuator information.

25. The computer-readable medium of claim 24, further comprising identifying the lever scaling factor based on the lever advantage set.

26. The computer-readable medium of claim 24, wherein the lever scaling factor has been determined by testing the loudness of a plurality of keys associated with the lever advantage set.

27. The computer-readable medium of claim 24, wherein the lever scaling factor is calculated by dividing a first loudness associated with a default lever advantage set by a second loudness associated with the lever advantage set.

28. The computer-readable medium of claim 21, wherein the lever-adjusted drive is determined by consulting a lookup table.

29. The computer-readable medium of claim 28, wherein the normalized drive is used an address of the lookup table.

30. The computer-readable medium of claim 28, further comprising:

selecting the lookup table from a plurality of lookup tables based on the actuator information.

* * * * *